US007424852B2

(12) United States Patent
Dempster et al.

(10) Patent No.: US 7,424,852 B2
(45) Date of Patent: Sep. 16, 2008

(54) UNIVERSAL WARNING STRIPE SLITTING MACHINE

(75) Inventors: John Dempster, Mississauga (CA); Blair Boudreau, Mississauga (CA); Dianne Bateman, Kitchener (CA)

(73) Assignee: NCR Corporation, Dayton, OH (US)

( * ) Notice: Subject to any disclaimer, the term of this patent is extended or adjusted under 35 U.S.C. 154(b) by 355 days.

(21) Appl. No.: 10/960,846

(22) Filed: Oct. 7, 2004

(65) Prior Publication Data

US 2006/0078714 A1 Apr. 13, 2006

(51) Int. Cl.
*B41F 13/56* (2006.01)
*B41J 11/00* (2006.01)

(52) U.S. Cl. ..... 101/226; 400/621.1

(58) Field of Classification Search ..... 101/226; 400/621.1

See application file for complete search history.

(56) References Cited

U.S. PATENT DOCUMENTS 3,663,359 A * 5/1972 Braim ..... 162/105
3,713,601 A * 1/1973 Buhrman et al. ..... 242/611.2
3,731,649 A * 5/1973 Anderson et al. ..... 118/672
3,885,518 A * 5/1975 Varni ..... 118/673
4,128,348 A * 12/1978 Steele et al. ..... 400/198
4,475,830 A * 10/1984 Schaefer ..... 400/238
4,484,970 A * 11/1984 Burzlaff et al. ..... 156/233
4,797,016 A * 1/1989 Lahr ..... 400/237
4,863,297 A * 9/1989 Fujii ..... 400/249
6,161,604 A * 12/2000 Richards et al. ..... 156/504
6,334,722 B1 * 1/2002 Aoki et al. ..... 400/242

OTHER PUBLICATIONS

John Dusenbery Co, Inc.,"Model 614, Installation and Operation Manual," 1976, pp: Cover, Table of Contents, 1-1 to 7.6.

* cited by examiner

*Primary Examiner*—Anthony H. Nguyen
(74) *Attorney, Agent, or Firm*—Francis L. Conte; Charles Q. Maney

(57) ABSTRACT

A slitting machine includes a stand for supporting a web which is slit into multiple ribbons by a plurality of blades, with the ribbons being wound on corresponding cores supported on an arbor. A common ink roller is mounted across the feedpath of the web and has a printing surface configured to print an end-of-roll warning stripe in a universal pattern bridging adjacent ribbons irrespective of individual width thereof.

20 Claims, 6 Drawing Sheets

10

UNIVERSAL WARNING STRIPE SLITTING MACHINE

BACKGROUND OF THE INVENTION

The present invention relates generally to paper slitting machines, and, more specifically, to end-of-roll warning stripes printed therein.

The ubiquitous paper roll is found in various sizes for various applications including cash registers, ATM machines, adding machines, and receipt printers. Each roll typically includes a paper or plastic core around which is wound a continuous ribbon of paper.

Paper rolls are typically produced in a slitting machine in which a large mill roll of paper is mounted at one end of the machine, unwound through the machine, and then slit at numerous locations along its width to provide corresponding ribbons which are then wound on corresponding cores commonly mounted on a supporting arbor or mandrel. The slitting operation is effected by a pair of circular knives or blades which slit the web in a typical shear cut for each of the cores.

In a single production run of paper cores, several cores are mounted coaxially around the supporting arbor in longitudinal abutting contact, and fixedly mounted on the arbor by end fittings or nuts. The arbor is then mounted in the slitting machine.

The slitting blades in the machine are typically arranged in pairs on opposite sides of the paper web with the corresponding cutting or shearing lines thereof being suitably aligned with the respective joints between the cores on the arbor.

In one conventional slitting machine, a row of first circular slitting blades are mounted on a first shaft on one side of the web. The first blades are separated from each other by corresponding precision spacers and thin shims as required to precisely align the cutting edges of the first blades with the corresponding joints between the cores.

A set of second circular blades are pivotally mounted on a second shaft in the machine to selectively engage or disengage the corresponding first blades. Each of the second blades is conventionally mounted in a supporting holder which may be adjusted in position along a supporting dovetail attached to the second shaft. The individual holders may then be adjusted along the dovetail for properly engaging the second blades with their first blade counterparts to control the precise width of each ribbon slit from the web, and also control the cutting overlap or depth between the pairs of first and second blades.

Each production run of paper cores requires the set up of the individual cores on the arbor, alignment thereof with the first blades, and corresponding alignment of the second blades with the first blades, and takes considerable time. Since the first and second blade sets are integral parts of the slitting machine itself, and the arbor must be suitably mounted therein, the slitting machine cannot be operated during the set up procedure which correspondingly reduces the throughput of the machine, and therefore affects cost of operation.

Adding to the set up process for a particular batch run of paper rolls is the alignment required for printing end-of-roll warning stripes. At the commencement of each production run, the leading edge of each ribbon is initially tucked around the empty core and a warning stripe is printed for a short portion of the roll length, for example about three feet. In this way, when the roll is later depleted in use by the user the end-of-roll warning stripe will be visible as the ribbon is dispensed from the printer to alert the user that the paper roll requires changing.

The warning stripe is typically printed in the slitting machine with a suitable color ink in a narrow vertical stripe along one or both edges of the paper roll. This is typically effected by using an inking wick which bridges each of the ribbon slits for simultaneously printing warning stripes along the common slit of the adjoining ribbons. In this way, each ribbon will have a vertical warning stripe printed solely along each edge of the ribbon for the short length of about three feet.

In another conventional slitting machine, the warning stripe may be printed using individual printing rollers which bridge the respective ribbon slits for printing the stripe along the common edges of the ribbons at the slit line. The individual rollers have a hub with a set screw that permits their lateral adjustment along the length of a common supporting shaft.

In either configuration, the printing wicks or the printing rollers must be individually aligned with the respective slit lines for the intended width of the individual rolls to be produced. The typical mill roll has a width of about 53.5 inches, and 11 to 35 rolls may be formed depending upon the standard width thereof. And, the required alignment procedure to print the warning stripes along the several slit lines increases the down time of the machine, and correspondingly increases cost of the paper rolls.

Accordingly, it is desired to provide an improved slitting machine in which downtime for set up of each production run may be minimized for maximizing use of the machine.

BRIEF SUMMARY OF THE INVENTION

A slitting machine includes a stand for supporting a web which is slit into multiple ribbons by a plurality of blades, with the ribbons being wound on corresponding cores supported on an arbor. A common ink roller is mounted across the feedpath of the web and has a printing surface configured to print an end-of-roll warning stripe in a universal pattern bridging adjacent ribbons irrespective of individual width thereof.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DETAILED DESCRIPTION OF THE INVENTION

Figure 1:
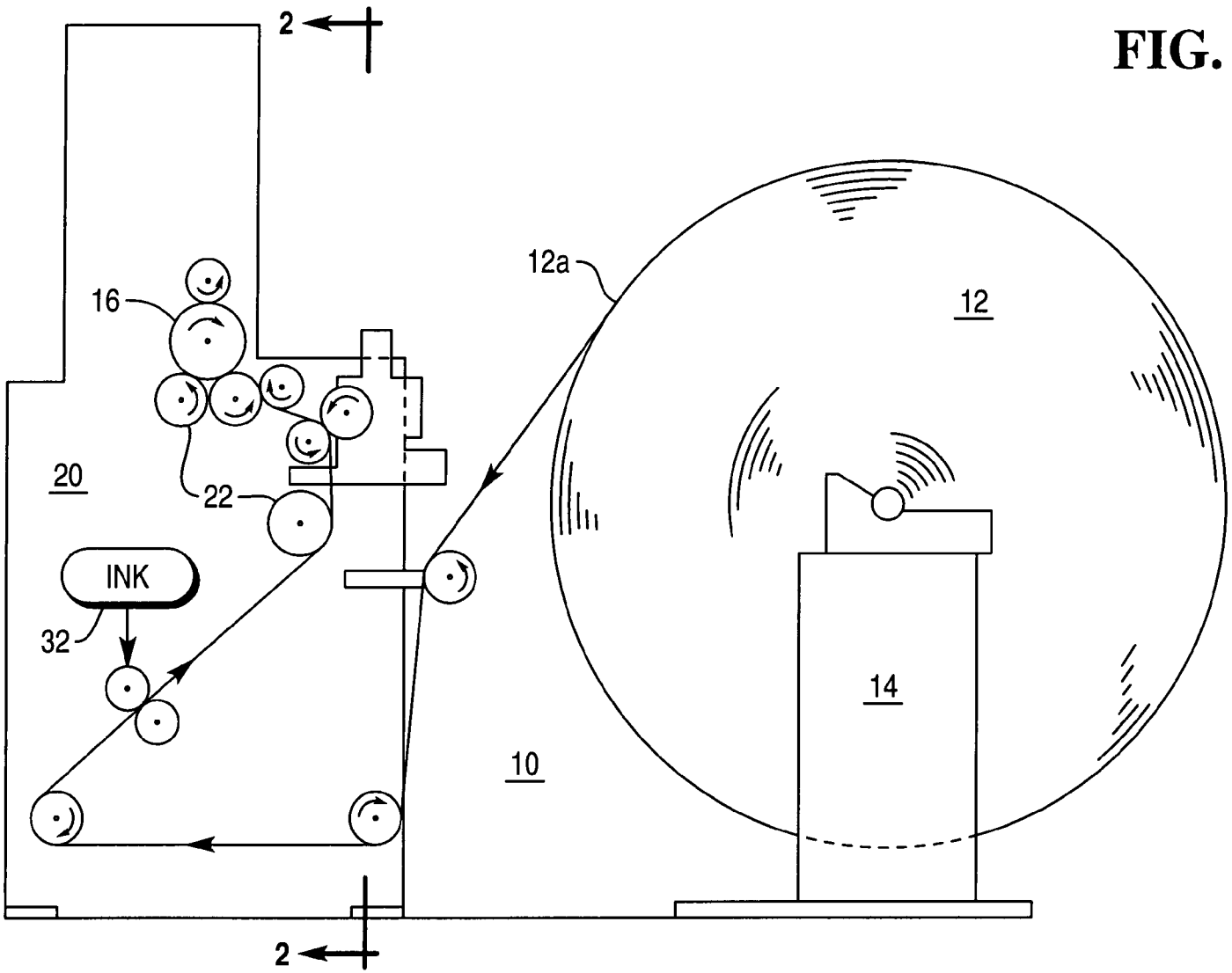
FIG. 1 is a side elevational view of an exemplary slitting machine including a warning stripe printer therein.
Figure 2:
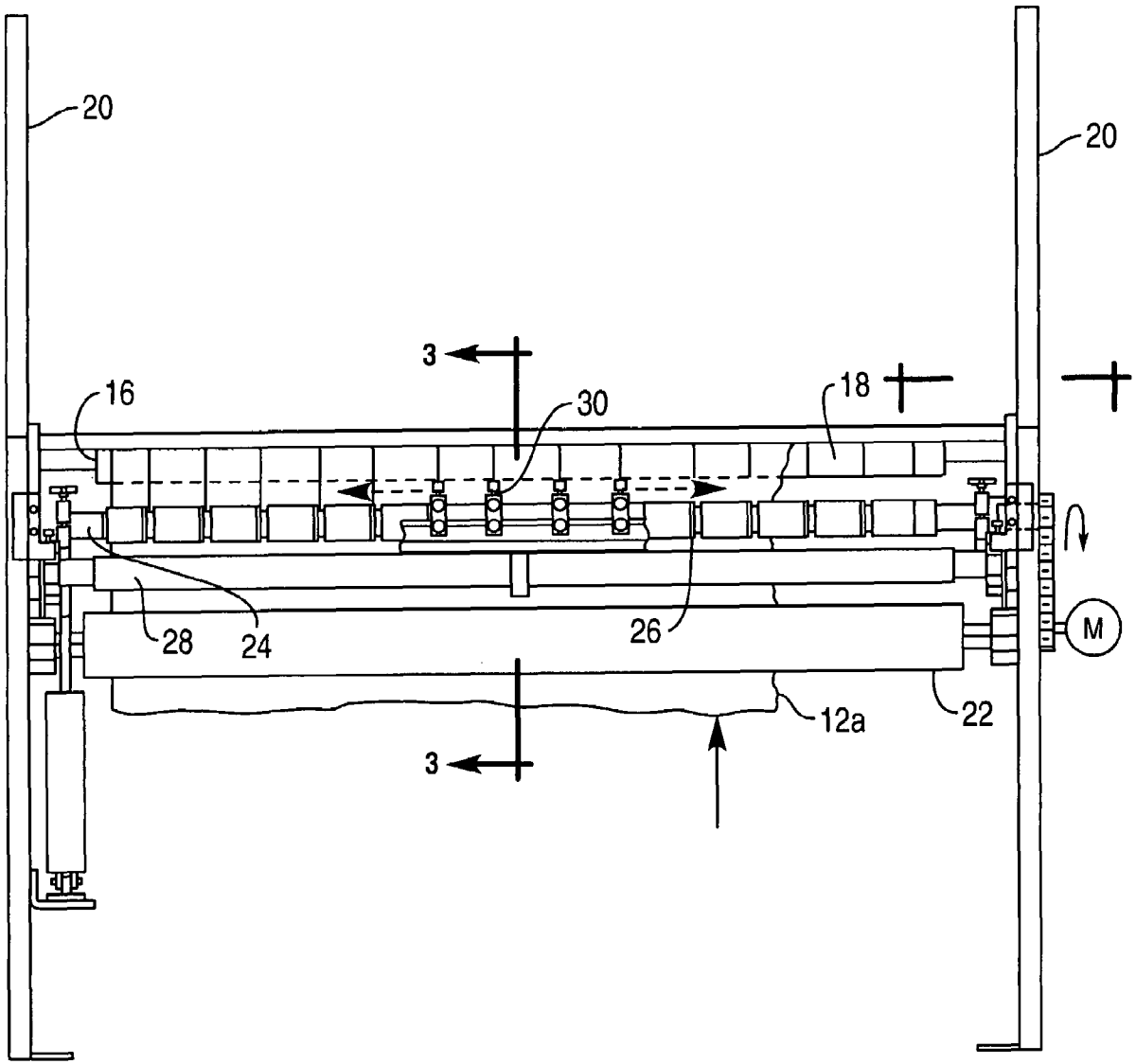
FIG. 2 is an elevational sectional through the machine of FIG. 1 and taken generally line 2-2.

Illustrated schematically in FIGS. 1 and 2 is a paper roll slitting machine 10 configured for cutting or slitting into multiple strands or ribbons 12*b* the web 12*a* unwound from a mill roll 12. As shown in FIG. 1, the machine includes an unwind stand 14 disposed at one end for rotatably mounting the mill roll 12 on a supporting shaft extending through the center thereof. The web is pulled during operation from the roll for unwinding therefrom and is then slit in multiple ribbons along the travel or feedpath through the machine.

A mandrel or arbor 16 is suitably rotatably mounted at an opposite end of the machine at the end of the feedpath for the web for winding the ribbons around a plurality of cores 18 suitably mounted on the arbor as illustrated in FIG. 2. The cores may be plastic or paper, for example, and simply abut each other along the longitudinal length of the arbor and are secured thereon by end clamps or nuts at the opposite ends of the arbor.

The slitting machine illustrated in FIGS. 1 and 2 includes a pair of laterally opposite or spaced apart endwalls 20 and various frame components for providing structural integrity to the machine and mounting the various components thereof. For example, the machine includes various rollers or rolls, generally designated 22, which define the feedpath for the web 12*a* of the roll as it is unwound from the stand 14 at one end of the machine, slit into multiple ribbons, and then rewound on the corresponding cores supported on the arbor 16.

The arbor rests on a pair of bed rolls, with a riding roll resting atop the arbor. A nip roll immediately precedes the two bed rolls, and three idler rolls are located upstream in the feedpath to suitably guide the unwinding web from the mill roll into the machine for slitting thereof. A spreader roller immediately follows the last idler roll prior to slitting of the web into the multiple ribbons.

Figure 3:
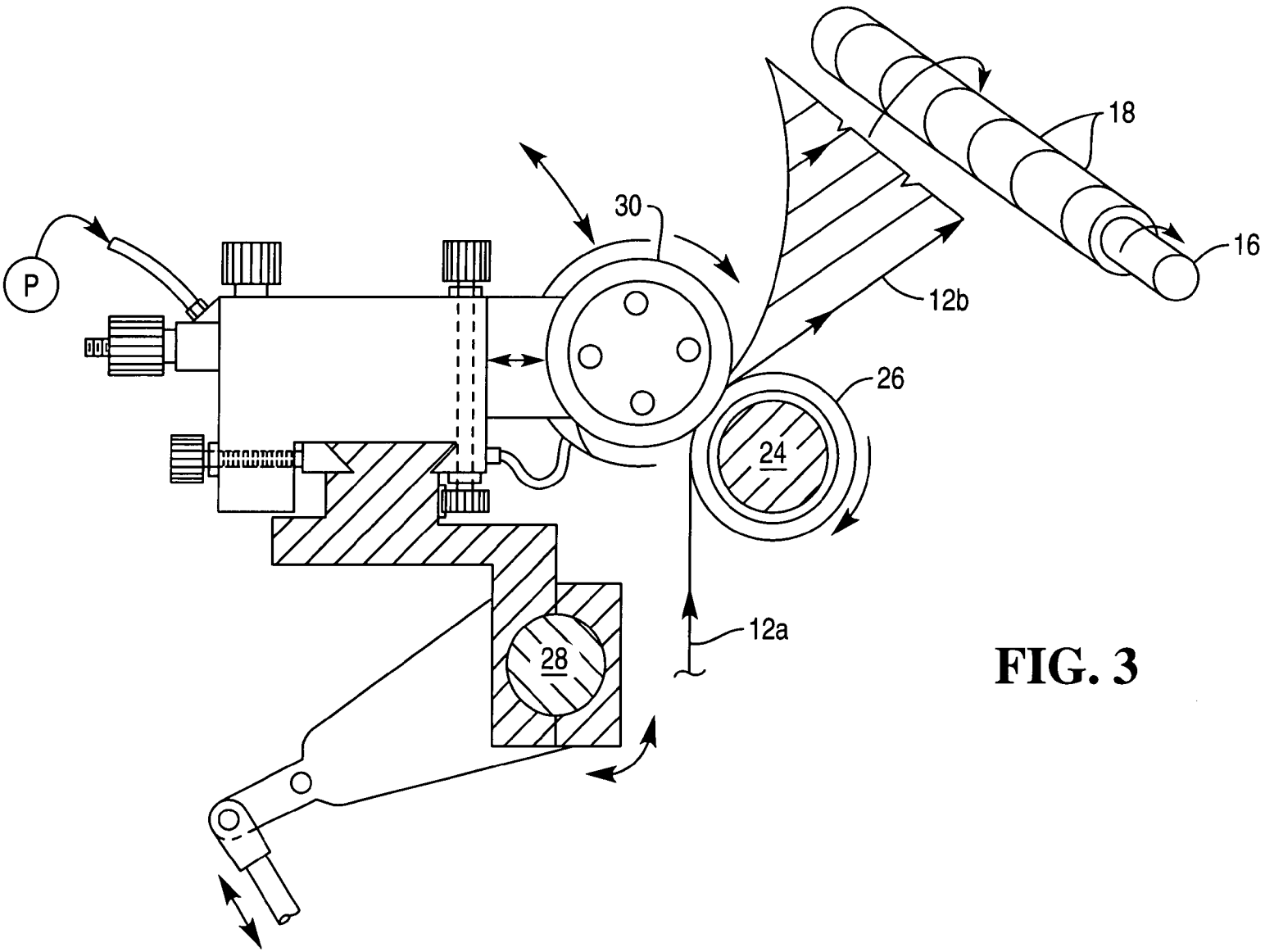
FIG. 3 is a partly sectional side elevational through the slitting machine of FIG. 2 and taken along line 3-3.

As shown in FIGS. 2 and 3, a first shaft 24 includes a plurality of first circular knives or blades 26 spaced longitudinally apart by corresponding tubular spacers and thin circular shims of various thickness as required. The spacers and shims are selected to position each of the first blades 26 on the shaft in a precise location aligned with the corresponding ends or junctions between adjacent cores 18 fixedly mounted on the arbor 16.

A second shaft 28 is pivotally mounted at opposite longitudinal ends between the two endwalls 20. The second shaft is spaced laterally from the first shaft, and is parallel therewith.

A plurality of second circular knives or blades 30 adjoin respective ones of the first blades 26 and are mounted in suitable blade holders which in turn are supported on the first shaft 24. The blade holders illustrated in FIG. 3 are pneumatically operated to selectively engage the second blades 30 with the first blades 26 for cutting in shear the mill web into a suitable number of the ribbons 12*b*, typically with equal width.

The slitting machine as described above is conventional in configuration and operation and is configured to unwind the mill roll from the stand, slit the wide web into multiple narrow ribbons, and then wind the individual ribbons on the respective cores supported on the common arbor.

As indicated above, various numbers of the cores may be mounted on the common arbor depending upon the desired width of the individual paper rolls to be produced. For example, 11 to 35 cores of equal standard width may be mounted on the common arbor for producing a corresponding number of paper rolls.

Once the number of cores is determined, a corresponding number of the first blades 26 are mounted on the first shaft 24 and adjusted in lateral position to correspond with the junctions between the adjoining cores. Correspondingly, each of the second blades 30 must then be laterally adjusted along the length of the second shaft 28 for alignment with a respective one of the first blades 26.

As shown in FIG. 3, each holder for the second blades 30 includes a rack and pinion for conveniently adjusting the lateral position of the blade holder and supported second blade 30. The holder also includes a suitable clamp to lock the lateral position of the aligned second blade. And, the blade holder is pneumatically driven to engage the second blade 30 to partially overlap the corresponding first blade 26 to produce a shearing knife combination which slits the web during operation.

One conventional form of the basic slitting machine 10 is commercially available from the John Dusenbery Company of Randolf, N.J., under Model 625. Another conventional form of the slitting machine is available from the Jennerjahn Company of Matthews, Ind., under Model 1639.

In both of these conventional slitting machines, printing wicks or rollers are provided for printing an end-of-roll warning stripe over a short distance of the initial end of the ribbons as they are initially wound onto the corresponding cores. As indicated above, the alignment of the individual wicks or printing rollers increases the set up time for each production run and correspondingly reduces productivity of the machine.

Figure 4:
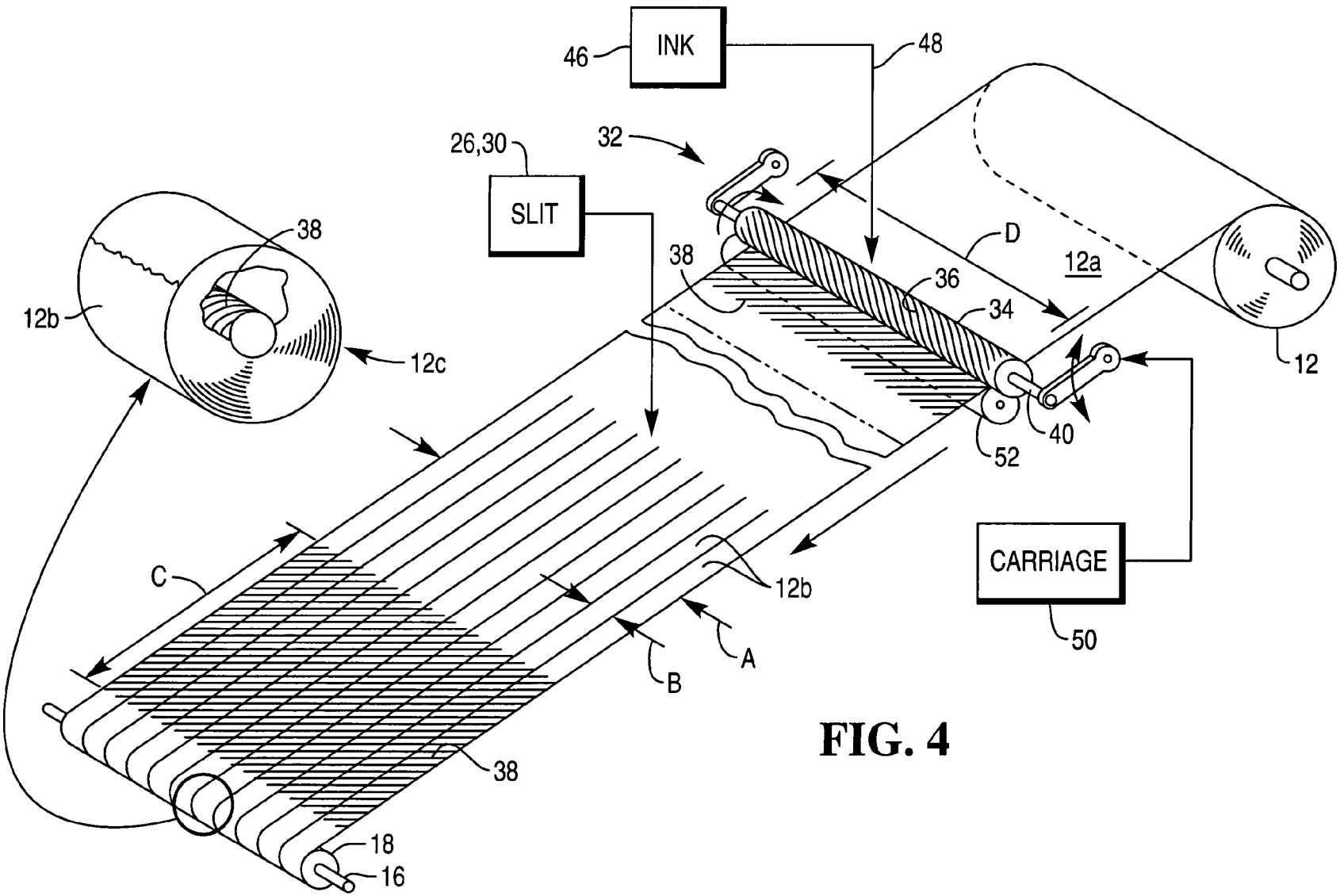
FIG. 4 is a schematic representation of the slitting machine illustrated in FIGS. 1-3 including the warning stripe printer in accordance with an exemplary embodiment.

As illustrated schematically in FIGS. 1 and 4, the otherwise conventional slitting machine is modified to include an improved end-of-roll warning stripe printer 32 at any convenient location along the running axis or feedpath of the web 12*a*. Instead of using individual ink rollers or wicks, the printer 32 as best illustrated in FIG. 4 includes a common ink roller 34 suitably mounted across the feedpath of the web 12*a*.

The ink roller has an external printing surface 36 specifically configured to print an end-of-roll warning signal or stripe 38 in a universal or common pattern bridging preferably all of the full complement of individual ribbons 12*b* across the full width A of the web 12*a* irrespective of the individual width B of each of the ribbons.

In a conventional manner, the warning stripe is intermittently printed over a short length C of the web during the initial production of the paper rolls, which warning stripe then becomes visible as the individual paper rolls are later depleted during use.

The machine is conventionally configured to initially tuck the leading edge of the individual ribbons around the empty cores 18 followed in turn by the short length C of warning stripes, with the remainder of the length of the wound ribbon being clean without further printing thereon as desired.

The typical width A of the mill roll is about 53.5 inches, with the individual widths B of the ribbons having standard sizes ranging from about 1.5 inches to about 4.5 inches corresponding with 35 to 11 cores or rolls mounted on the common arbor 16. The length C of the warning stripes is about three feet in a typical roll having hundreds of feet of ribbon wound thereon.

A particular advantage of the single ink roller 34 illustrated in FIG. 4 is that its length D corresponds with the collective width of the full complement of cores 16 on the arbor 16 to laterally bridge the full width A of the web 12*a*. Since the common ink roller 34 is preferably at least as long as the web 12 is wide the universal warning stripe 38 will be printed across the full width of all of the individual ribbons 12*b* without regard to the specific width thereof, from narrow to wide depending upon the standard width of the paper rolls to be produced.

As indicated above, conventional ink printing wicks or rollers require individual adjustment of their location for the specific width of the rolls to be produced. This requires substantial set up time, and corresponding loss of productivity. However, the common ink roller 34 is installed in the slitting machine only once and requires no additional set up time since its printing coverage extends across the entire width of the mill roll irrespective of the number and size of the individual rolls to be produced.

Figure 5:
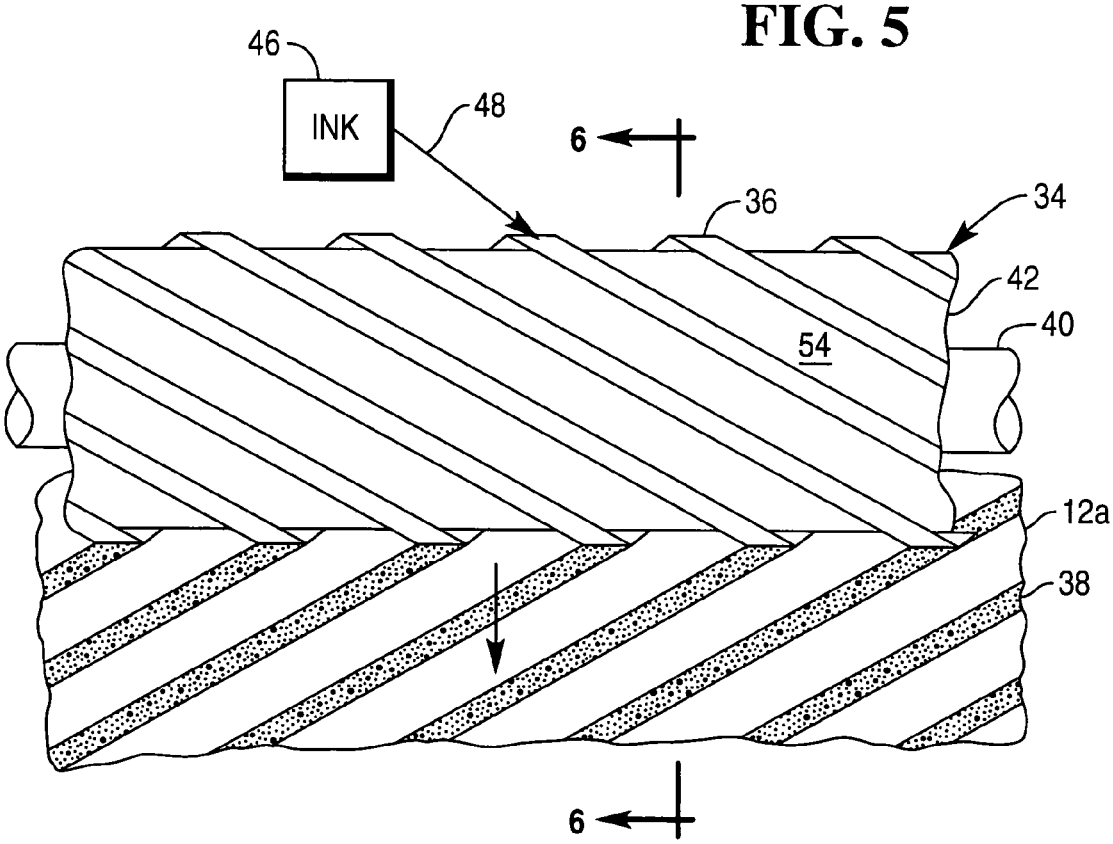
FIG. 5 is an enlarged view of a portion of the ink roller in the printer illustrated in FIG. 4 configured for printing diagonal warning stripes across the web.

As shown in FIGS. 4 and 5, the printing surface 36 of the ink roller 34 is preferably configured to print the warning stripe 38 in a common pattern bridging individual ones of the several ribbons 12*b*, with the pattern repeating from ribbon to ribbon across the width of the web. The pattern not only covers the edges of each ribbon along the common slit lines, but also covers each ribbon inboard from its lateral edges and across the middle of the ribbons as well.

In this way, irrespective of the individual width of the ribbons and the associated slit lines, the universal warning stripe will be printed across the full width of each of the ribbons without the need for additional alignment of the common ink roller 34 relative to the individual slit lines.

Figure 6:
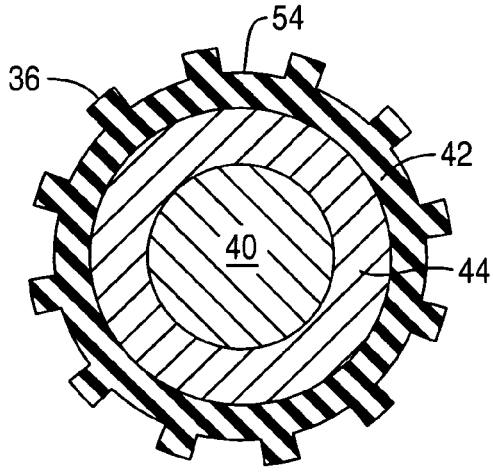
FIG. 6 is a transverse sectional view through the exemplary ink roller illustrated in FIG. 5 and taken along line 6-6.

FIGS. 5 and 6 illustrate an exemplary embodiment of the ink roller 34 which includes a metal support shaft 40 sufficiently long to bridge the entire width of the web 12*a* as illustrated in FIG. 4, and with a suitable outer diameter, of about 1.5 inches for example, to provide sufficient rigidity for the ink roller across the full width of the web. A preferably rubber or synthetic tubular sleeve 42 is fixedly mounted coaxially on the supporting shaft 40 and is sized in length D to bridge the entire web 12*a* as indicated above. The printing surface 36 is formed around the outer perimeter of the sleeve in any convenient manner, such as by machining therein.

The sleeve 42 may be relatively thin and in turn mounted on a tubular metal hub 44 through which the supporting shaft 40 extends. In alternate embodiments, the ink roller 34 may be configured in any suitable manner to provide sufficient rigidity across the entire width of the web 12*a*, while also providing a suitable external printing surface for printing the warning stripe 38 in the desired universal pattern to bridge all of the individual ribbons being cut from the common web.

As indicated above, the sleeve 42 is preferably a non-metal material, such as rubber, which may be easily machined at low cost for producing the desired universal printing pattern, and having a suitable surface finish for transferring and printing ink.

As shown schematically in FIGS. 4 and 5, the printer 32 includes a dispenser or suitable means 46 for applying ink 48 to the ink roller 34 as the roller rotates during operation to print the universal warning stripe across the full width of the web as the web is unwound from the mill roll 12, with the individual slit ribbons being correspondingly wound on the individual cores 18.

FIG. 4 also illustrates schematically a carriage 50 which may have any conventional form for supporting the ink roller 34 adjacent to the web 12*a* at any convenient location along the feedpath. For example, the opposite ends of the supporting shaft 40 may be suitably mounted in crank arms or levers in the carriage 50 which intermittently position the ink roller onto the running web when desired, and otherwise disengage the ink roller. An idler roller or platen 52 may be used on the opposite side of the web 12*a* to cooperate with the ink roller 34 when engaged therewith for printing the web therebetween.

In this way, the slitting machine may be operated in a conventional manner to selectively engage the ink roller 34 against the running web 12*a* to produce the warning stripes 38 across the full width A thereof and for a desired running length C at the beginning of each of the ribbons being wound on the supporting cores 18.

In the preferred embodiment illustrated in FIG. 4, the printer and its carriage 50 are positioned before the slitting blades 26,30 along the feedpath of the web 12*a* to print the warning stripe 38 prior to slitting the web into the individual ribbons 12*a*. Since the warning stripe extends across the full width of the web, the various slit lines will nevertheless be formed through the common warning stripe irrespective of the lateral location of the slit lines for the individual width of the ribbons when cut. Accordingly, no additional alignment of the common ink roller 34 is required for printing the common warning stripe on all of the ribbons being produced.

As indicated above, the warning stripe 38 is preferably universal or common to all of the ribbons irrespective of the individual width thereof. In the exemplary embodiment illustrated in FIGS. 5 and 6, the printing sleeve 42 includes a plurality of recesses or grooves 54 in the outer perimeter thereof, with corresponding elevated printing lands 36 disposed therebetween which define the printing surface that corresponds with the universal warning stripe 38.

The grooves 54 and lands 36 preferably extend obliquely or diagonally to the longitudinal centerline axis of the sleeve 42 as illustrated in FIG. 5 for correspondingly printing warning stripes 38 obliquely or diagonally to the width of the ribbons 12*a*. For example, the diagonal or helical orientation of the grooves and lands may be about 30 degrees to the width of the web, or 60 degrees to the running axis or length of the web.

The grooves 54 as illustrated in FIG. 6 may be about 0.75 inches in width, about 0.25 inches in depth, with the intervening lands 36 being about 0.25 inches in width.

A particular advantage of this diagonal form of the printing lands 36 is maintaining stability of printing during the high speed operation of the slitting machine. For example, the slitting machine may be operated at throughput speeds of about 600 to about 1200 feet per minute, and correspondingly fast acceleration and deceleration times when producing paper rolls therein. Printing of the warning stripe occurs upon start up of each production batch as the machine is quickly accelerated to speed, with the warning stripe being printed for the very short initial length of the ribbons, of about three feet for example.

The diagonal printing lands 36 will smoothly engage the web 12 pressed against the underlying rotary platen 52 for maintaining printing stability and ensuring uniformly printed warning stripes. Furthermore, the supporting shaft 40 of the ink roller has a suitably large outer diameter for introducing sufficient rigidity across the full length of the ink roller to ensure uniform printing of the warning stripe across the full width of the web.

Figure 7:
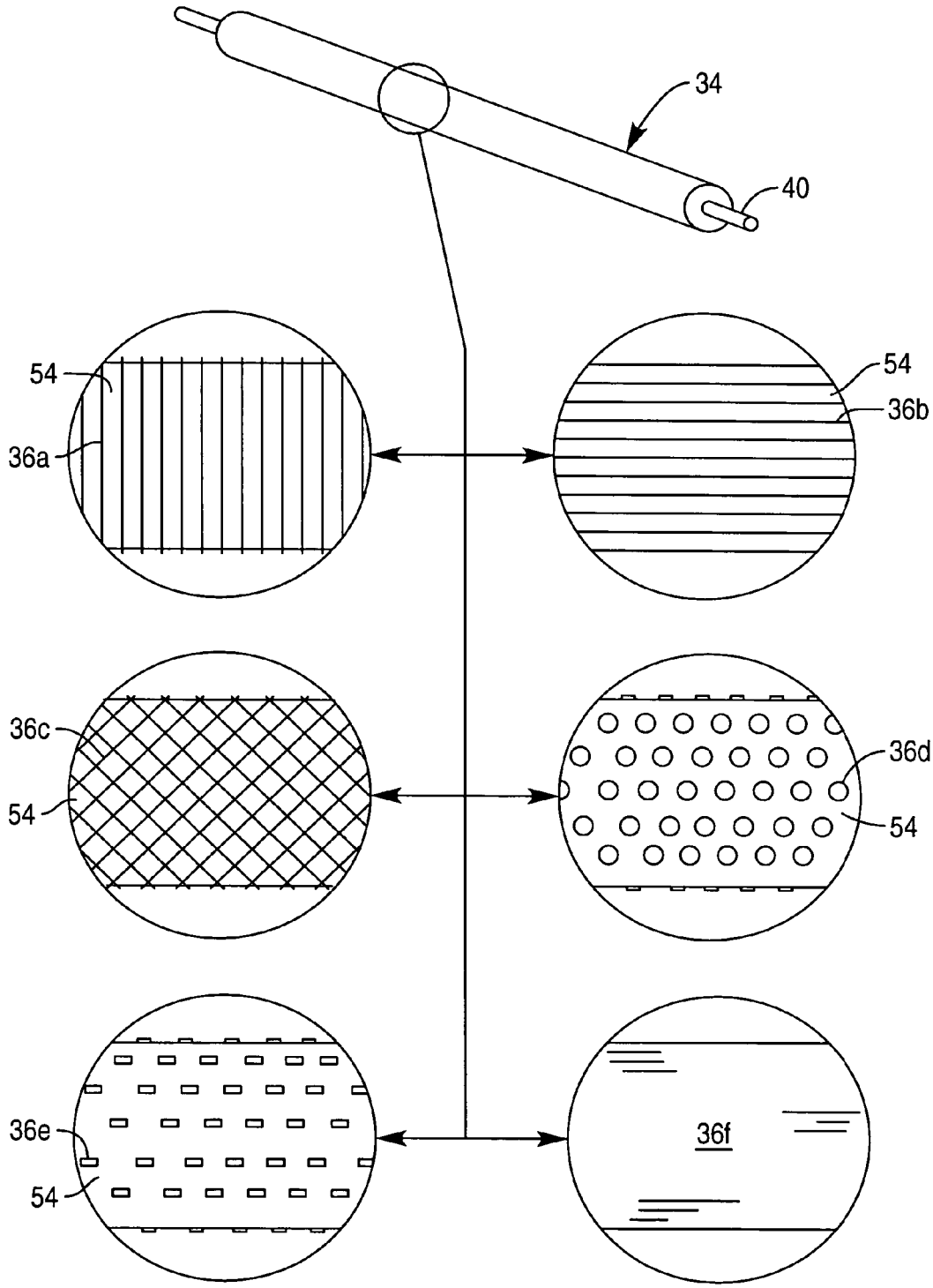
FIG. 7 is an isometric view of the ink roller illustrated in FIG. 4 in accordance with multiple alternate embodiments of the warning stripe printing pattern.

Since the common ink roller 34 may be used for printing a common or universal warning stripe over the several ribbons 12*b* being cut from the common web 12*a*, the form of the warning stripe 38 may vary as desired. FIGS. 4 and 5 illustrate the warning stripe in the exemplary form of diagonal lines formed by the corresponding diagonal printing lands 36. FIG. 7 illustrates schematically various additional forms of the printing lands which will form corresponding patterns in the printed warning stripe.

For example, the grooves 54 and lands 36*a* illustrated in FIG. 7 may extend perpendicularly across the longitudinal axis of the ink roller sleeve for correspondingly printing vertical warning stripes which run parallel along the feedpath or running axis of the individual ribbons 12*b*. The perpendicular or transverse lands 36*a* may have any suitable width and spacing or density, with sufficient density for printing several vertical stripes in each of the ribbons irrespective of the width thereof.

FIG. 7 also illustrates another embodiment in which the grooves 54 and lands 36*b* extend parallel to the longitudinal axis of the ink roller sleeve for correspondingly printing horizontal or transverse warning stripes across the width of the individual ribbons 12*b*. The horizontal stripes will cover the full width of each of the ribbons and may be spaced apart along the length of the ribbons with any suitable spacing.

FIG. 7 illustrates yet another embodiment of the grooves 54 and lands 36*c* which intersect each other in cross diagonals along the ink roller sleeve to form the typical knurling pattern for the warning stripes.

FIG. 7 additionally illustrates that the grooves 54 may be used to define other patterns of discrete printing lands such as the circular dots or lands 36*d* having a uniform spacing.

Alternatively, the discrete lands 36*e* may be rectangular or square in another uniform pattern. The discrete lands 36*d,e* will print corresponding uniform patterns in the warning strips across the width of the individual ribbons.

FIG. 7 finally illustrates that the ink roller sleeve may even include a continuous smooth outer printing surface 36*f* without any grooves at all, for correspondingly printing a continuous warning stripe across the full width of the web. In this embodiment, the printing ink may be suitably light in color, such as light blue, so that the warning stripe region at the end of the individual paper roll may still be used by the user for printing any desired information thereon, such as cash register receipts. Cash register information is typically printed in black ink which will continue to be discernible on the light blue background of the continuous warning stripe so that the paper roll may be fully used prior to being discarded.

Furthermore, the various forms and patterns of the warning stripes disclosed above may also be printed using any suitable color, which is preferably lighter than the intended printing color to be used by the user so that printing by the user may still be visible notwithstanding the various forms of the warning stripe.

The various forms of the warning stripe as implemented by the corresponding forms of the printing surface of the ink roller 34 may be selected in primary part by minimizing the cost of manufacture of the ink roller 34 and the associated cost of printing the warning stripe. The ink roller should be as simple as possible for reducing its cost. The warning stripes should also be as simple as possible for reducing the amount of ink needed for printing the warning stripes.

And, the particular pattern of the printing lands may be optimized for maintaining dynamic stability of the ink roller during operation in the high speed production of the slitting machine. A smooth and stable transition of the ink roller as it engages the moving web during slitting operation, as it prints the warning stripe, and as it disengages the web during operation should be maintained.

Accordingly, the relatively simple introduction of the common ink roller instead of the several discrete printing wicks or printing rollers previously used in the high speed slitting machines disclosed above can substantially reduce set up time for slitting machines between production runs and improve the overall productivity of paper roll manufacturing.

The modified slitting machine permits an improved method of use as described above which eliminates the need for repeated alignment of the common roller with the individual slit lines for different production runs. The resulting wound paper rolls 12*c* shown in FIG. 4 enjoy the advantage of lower cost production thereof, and include the unique uniform pattern of warning stripes 38 across the full width thereof, instead of the typical narrow edge stripes.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

The invention claimed is:

1. A slitting machine comprising:

a stand for supporting a web wound in a mill roll;

a plurality of blades spaced laterally apart to slit said web into multiple ribbons; an arbor supporting a plurality of cores for winding thereon respective ones of said ribbons; and a common ink roller mounted across the feedpath of said web, and having a printing surface configured to print an end of roll warning pattern across the full width of said web bridging all of said ribbons irrespective of the individual width thereof, wherein said common ink roller is further configured to print said end of roll warning pattern over a short length of all of said ribbons, proximate to a leading edge of each of said ribbons for winding on said plurality of cores, with the remainder of the length of said ribbons being clean without further printing thereon by said common ink roller.

2. A machine according to claim 1 wherein said ink roller corresponds in length to the collective width of said cores on said arbor to bridge the width of said web and print said warning pattern across all of said ribbons.

3. A machine according to claim 2 wherein said printing surface of said ink roller is further configured to print an end of roll warning pattern that repeats from ribbon to ribbon.

4. A machine according to claim 3 wherein said ink roller comprises:

a support shaft; and a tubular sleeve mounted coaxially on said support shaft and sized in length to bridge said web, and having said printing surface extending around the outer perimeter thereof.

5. A machine according to claim 4 wherein said sleeve comprises rubber.

6. A machine according to claim 4 wherein said sleeve includes a plurality of grooves in said perimeter thereof, with corresponding printing lands disposed therebetween to define said printing surface.

7. A machine according to claim 6 wherein said grooves and lands extends parallel to the longitudinal axis of said sleeve for printing horizontal warning stripes across the width of said ribbons.

8. A machine according to claim 6 wherein said grooves and lands extend obliquely to the longitudinal axis of said sleeve for printing warning stripes obliquely to the width of said ribbons.

9. A machine according to claim 8 wherein said grooves and lands extend diagonally to the longitudinal axis of said sleeve for printing diagonal warning stripes across the width of said ribbons.

10. A machine according to claim 9 wherein said grooves and lands intersect in cross diagonals along said sleeve.

11. A machine according to claim 8 wherein said grooves and lands extend perpendicularly across the longitudinal axis of said sleeve for printing vertical warning stripes along the feedpath of said ribbons.

12. A machine according to claim 6 wherein said grooves define a pattern of discrete lands.

13. A machine according to claim 12 wherein said discrete lands are circular.

14. A machine according to claim 12 wherein said discrete lands are rectangular.

15. A machine according to claim 4 wherein said sleeve includes a smooth outer printing surface for printing a continuous warning stripe across the width of said web.

16. A machine according to claim 4 further comprising means for applying ink to said ink roller.

17. A machine according to claim 4 further comprising a carriage supporting said ink roller adjacent to said web, and configured for selectively engaging said ink roller with said web to intermittently print said warning stripe thereon.

18. A machine according to claim 17 wherein said carriage is positioned before said blades along the feedpath of said web to print said warning stripe prior to slitting said web into said ribbons.

19. A method of using said machine according to claim 4 comprising:

slitting said web into said multiple ribbons;

printing said warning stripe across said multiple ribbons solely at the commencement of winding said cores; and winding said ribbons on said cores to prepare full rolls thereof.

20. A wound roll made by the method of claim 19.

* * * * *